United States Patent [19]

Takahashi et al.

[11] Patent Number: 4,943,507

[45] Date of Patent: Jul. 24, 1990

[54] TONER FOR DEVELOPING ELECTROSTATIC LATENT IMAGE AND METHOD FOR DEVELOPING ELECTROSTATIC LATENT IMAGE WITH THE SAME

[75] Inventors: Jiro Takahashi; Kenzi Tsuzita; Hiroyuki Takagiwa; Kunio Shigeta; Hiroya Masaki, all of Hachioji, Japan

[73] Assignee: Konishiroku Photo Industry Co., Ltd., Tokyo, Japan

[21] Appl. No.: 300,734

[22] Filed: Jan. 23, 1989

Related U.S. Application Data

[63] Continuation of Ser. No. 22,777, Mar. 6, 1987, abandoned.

[30] Foreign Application Priority Data

Mar. 11, 1986 [JP] Japan ..... 61-51330

[51] Int. Cl.[5] ..... G03G 13/09

[52] U.S. Cl. ..... 430/120; 430/122

[58] Field of Search ..... 430/110, 109, 120, 122

[56] References Cited

U.S. PATENT DOCUMENTS

| | | | |
|---|---|---|---|
| 4,600,676 | 7/1986 | Terada et al. | 430/110 |
| 4,626,487 | 12/1986 | Mitsohashi et al. | 430/110 |
| 4,652,509 | 3/1987 | Shirose et al. | 430/110 |
| 4,737,432 | 4/1988 | Tanaka et al. | 430/110 |

*Primary Examiner*—John L. Goodrow

*Attorney, Agent, or Firm*—Jordan B. Bierman

[57] ABSTRACT

A method of developing an electrostatic latent image wherein an electrostatic latent image with a negative polarity is formed on an organic photoreceptor and developed with a toner bearing a positive electric charge. The toner used to develop the latent image includes a binder resin, a coloring agent, silica, zinc stearate, and at least one oxide selected from hydrophobic aluminum oxide and hydrophobic titanium oxide. This method of developing the electrostatic latent image produces an image having a higher maximum image density.

26 Claims, No Drawings

TONER FOR DEVELOPING ELECTROSTATIC LATENT IMAGE AND METHOD FOR DEVELOPING ELECTROSTATIC LATENT IMAGE WITH THE SAME

This application is a Continuation of application Ser. No. 022,777, filed Mar. 6, 1987 now abandoned.

FIELD OF THE INVENTION

This invention relates to toners for developing electrostatic latent images reproduced in an electrophotographic process, an electrostatic printing process, an electrostatic recording process and so forth, and to the methods for developing electrostatic latent images with the same.

BACKGROUND OF THE INVENTION

A step for developing an electrostatic latent image means that charged fine grains are so attracted by electrostatic attraction as to adhere to the surface of an electrostatic image carrier and thereby the electrostatic latent image is made visible. The typical dry-processes each capable of performing such a developing step as mentioned above include, for example, a cascade process, a fur brush process, an impression process, a powder-cloud process and so forth. In any one of these processes, however, every toner used therein shall necessarily have a high fluidity. If such toners have a relatively low fluidity, no toner development can be performed smoothly, so that the image quality may be lowered.

The conventionally well-known processes of endowing toners with fluidity include, for example, a process of adding the fine particles of silica into the toners which were made to be hydrophobic, such as described in Japanese Patent O.P.I. Publication No. 47345/1973. The fluidity of toners can be improved by adding the above-mentioned hydrophobic fine silica particles into the toners and, resultingly, an excellet image having a high quality can be obtained. However, when a series of image reproductions are carried out continuously by making use of such toners, there may be arisen a problem that black spots may be produced on an image being reproduced. The phenomenon is taken place in the course of the following processing steps.

In electrophotograhy and so forth, it is necessary to apply a cleaning step of removing toners remaining on an electrostatic image carrier, after carrying out an image transferring step of transferring a toner image formed on an electrostatic image carrier to another medium such a paper sheet. In the above-mentioned cleaning step, a blade cleaning means is normally used so as to make a cleaning efficiency higher and a staining possibility to the surroundings less. When using the toners being added with the above-mentioned hydrophobilc fine silica particles, however, black spots are produced on an image, because spot-shaped residues are produced on an electrostatic image carrier after the toners passed through such a cleaning blade, so that photoconductivity is lowered in the portions of the black spots.

It is an object of the invention to provide electrostatic image developing toners which do not produce such black spots as described above and are, in addition, excellent in fluidity.

As for the electrostatic image carriers generally used in electrophotograhy and so forth, those of the zinc oxide type, selenium type, cadmium sulfide type or organic photoreceptor type are well-known. Among those carriers, the organic photoreceptor type carriers are preferably used, from the general points of view, such as sensitivity, printing resistance, pollution-free property, cost performance and so forth.

The above-mentioned organic photoreceptors are comprised of an organic substance. Therefore, such organic photoreceptors are readily be oxidized by ozone, for example and the surface thereof is also readily be made hydrophilic when some foreign matter adheres thereto and, in addition, the so-called image blur may sometimes be produced by lowering the surface resistance of the photoreceptor in high humidity conditions.

Another object of the invention is to provide electrostatic image developing toners by which any image blurs can be inhibited even when using an organic photoreceptor which is advantageous for a photoreceptor.

Further, in an image developing or transferring step which is to be carried out in electrophotography and so forth, toners shall necessarily be charged sufficiently by a frictional charge so as to display an excellent developability and an excellent image transferability. If the toners are not sufficiently charged, an undesirable phenomenon, that is so-called a non-image-transferred area, is taken place due to the deterioration of developability especially in the conditions such as in the circumstances of high temperature and humidity.

A further object of the invention is to provide electrostatic image developing toners capable of displaying an excellent developability and image transferability even in the conditions of a high temperature and a high humidity.

A still further object of the invention is to provide a method of developing an electrostatic latent image formed on an organic photoreceptor not accompanying any of the above-mentioned disadvantages.

SUMMARY OF THE INVENTION

The above-mentioned objects of this invention can be achieved with toner for developing electrostatic latent image which comprises fine powder comprising an organic binder resin and a coloring agent, at least one selected from the group consisting of a hydrophobic aluminium oxide and a hydrophobic titanium oxide, a silica and a lubricant.

DETAILED DESCRIPTION OF THE INVENTION

The toners to be used in the invention are comprised of a binder resin, a coloring agent and other characteristic improving agent. When using the toners in the form of magnetic toners, they contain a magnetic substance together with or in place of the coloring agent. The binder resins to be used in the invention include, for example, a rosin resin, a vinyl resin, an acryl resin, an olefin resin, a polyamide resin, a polyester resin, a ketone resin, an epoxy resin, a phenol resin and so forth and the mixture thereof, every of which have publicly been well-known.

The coloring agents to be used in the invention include, for example, a carbon black, a Nigrosine dye (C.I. No. 50415B), an Aniline Blue (C.I. No. 50405), a chalcoil blue (C.I. No. azoic Blue 3), a chrome yellow (C.I. No. 14090), an ultramarine blue (C.I. No.77103), a DuPont Oil Red (C.I. No. 26105), a quinoline yellow (C.I. No. 47005), a methylene blue chloride (C.I. No.

52015), a phthalocyanine blue (C.I. No 74160), a Malachite Green oxalate (C.I. No. 42000), a lamp black (C.I. No. 77266), a Rose Bengale (C.I. No. 45435) and the mixtures thereof and so forth. The above-mentioned coloring agents may preferably be used, ordinarily, in a proportion of the order of from 1 to 20 parts by weight to 100 parts by weight of a binder used.

The magnetic substances which may be used in the invention include, for example, the metals or the alloys thereof each displaying a ferromagnetism such as iron, cobalt, nickel and so forth as well as ferrite and megnetite; the alloys or compounds each containing the above-mentioned elements; the alloys capable of displaying ferromagnetism not by containing any ferromagnetic element but by applying a suitable heat treatment thereto, which belong to the category of the so-called Heusler's alloys each containing manganese and copper, such as a manganese-copper-aluminium alloy, a manganese-copper-tin alloy or the like; chromium dioxide; and so forth.

The above-mentioned magnetic substances are uniformly dispersed in the form of fine powders into binders. The contents of such magnetic substances are to be from 20 to 70 parts by weight and, more preferably, from 40 to 70 parts by weight, to 100 parts by weight of toners.

The aluminium oxides and/or titanium oxides to be used in the invention may be treated to 30% or lower in hydrophobicity and, more preferably, to 50% or lower. In the invention, 'a hydrophobic treatment' means that hydroxyl groups each coupling to an aluminium oxide or a titanium oxide are to be eliminated. Such a hydrophobic treatment is carried out by reacting a subject substance with an alkyl halogenated silane such as a dialkyl dihalogenated silane, a trialkyl halogenated silane, an alkyl trihalogenated silane; an alkyl alkoxy silane; a hexalkyl disilazane or the like, at a high temperature.

The aluminium oxides and/or titanium oxides having a hydrophobicity of not more than 30% have an advantage that image qualities are remarkably varied because the moisture in the air may readily be adsorbed in cooperation with the small particle size thereof and the fluidity may also be varied according to the change in surroundings. From the viewpoint of the effect of the metal oxides to serve as a fluidizing agent, it is necessary that the particle sizes thereof is preferably 0.001 to 1 μm and, more preferably, 0.001 to 0.5 μm.

The particles of the hydrophobic aluminium and/or titanium oxides are present in a state where the oxides are mixed with toners or in another state where such oxides are coated over the toners, and the content thereof is 0.01 to 10% by weight to a total amount of the toners used and, more preferably, 0.05 to 5% thereto.

The silica to be used in the invention is a generally known colloidal silica and, more preferably, those treated so as to be phydrophobic. The well-known examples of the colloidal silica include 'Aerosil 200', 'Aerosil 300', 'Aerosil 130' (each manufactured by Japan Aerosil Co.) and so forth. The examples of the hydrophobic silica particles include 'Aerosil R-927', 'Aerosil R-812', 'Aerosil R-805', (each manufactured by Japan Aerosil Co.) and so forth.

The content of the above-mentioned silica particles is from 0.01 to 5% by weight to a total amount of toners used and, more preferably, from 0.05 to 2% by weight thereto, so that the toners may sufficiently be charged and no black spot may surely be produced.

The lubricants to be used in the invention include, for example, zinc stearate, lithium stearate, sodium stearate, stearic acid, a hardened castor oil and so forth. These lubricants may be used in an amount within the range of from 0.01 to 2% by weight to a total amount of toners used.

Besides the above, a characteristic improving agent may also be used in the invention. As for serving as the characteristic improving agents, offset-preventing agents such as a low molecular weight polypropylene, a low molecular weight polyethylene, an aliphatic amide wax, an aliphatic ester wax and so forth may be added.

It is also allowed to add charge-controlling agents including, for example, quaternary salt compounds each containing a nitrogen atom, such as a nigrosine dye, a pyridinium salt, an ammonium salt and so forth.

The toners of the invention may be applied to a process of developing electrostatic images with carriers in combination, by utilizing such a developing method as a magnetic brush method that is one of the dry developing methods. As for the carriers to be used in the above-mentioned case, the powders of a magnetic substance having a powder size of from 20 to 200 μm, such as those of ferrite, magnetite and so forth may be used as they are, or the powder particles thereof covered with a styrene-acryl resin, a vinylpyridine resin, a fluorine resin or the like or the powder particles of a magnetic substance dispersed in resins may also be used.

The toners of the invention are to develop an electrostatic image formed by negatively charging an organic photoreceptor used as a photoreceptor. It is accordingly necessary to positively charge the toners and, therefore, the negatively charged carriers are preferable. Such negatively charged carriers may be prepared by using a negatively charged covering resin or binder resin forming a part of the individual carrier and, more preperably, by using such a fluorine resin as a tetrafluoroethylene resin, a fluorovinylidene resin, a fluoroacrylate resin, a fluoromethacrylate resin, the copolymers thereof and so forth.

In the invention, there is not any special limitation to the carrier generating substances capable of being used on an organic photo-receptor which is electrostatically charged in the negative, out they typically include, for example, an anthanthrone type pigment, a perillene derivative, a phthalocyanine type pigment, an azo type dye, an indigoid type dye and so forth.

In the invention, the carrier transport substances include, for example, a carbazole derivative, an oxadiazole derivative, a triarylamine derivative, a polyarylalkane derivative, a pyrazoline derivative and so forth, as well as the aforementioned hydrazone type compounds and/or styryl type compounds.

In the invention, the photo-receptors capable of being used therein may be produced in accordance with the descriptions in the literatures well-known to the skilled in the art such as Japanese Patent O.P.I. Publication No. 172045/1985.

As will be obvious from the descriptions of the following examples, according to the above-mentioned toners, a number of excellent visible images may be reproduced stably without having any image blur and non-image-transferred area even in the conditions of a high temperature and humidity, provided an organic photoreceptor is suitably used.

The reason why such excellent effects can be enjoyed is not definitely cleared. It may, however, be considered that the fluidity of a developer used may be excellent because of the content of silica, a suitable polishing work may be so applied to an organic photoreceptor as to constantly refresh the surface of the photoreceptor because of the contents of an aluminium oxides and/or a titanium oxides and a lubricant and, thereby black spots and blurred images may be prevented and, resultingly, an excellent developability and image transferability can be displayed even in the conditions of a high temperature and a high humidity.

EXAMPLES

The examples of the invention will now be described below. It is, however, to be understood that the scope of the invention shall not be limited thereto.

Synthesis Example 1

Terephthalic acid of 299 g, 211 g of poluoxypropylene-(2,2)-2,2-bis(4-hydroxyphenyl)propane and 82 g of pentaerythritol were put together into a round bottom flask equipped with a thermometer, a stainless steel made stirrer, a glass made nitrogen-gas introducing tube and a flow type condenser and the flask was set to a mantle heater and nitrogen gas was then introduced thereinto from the nitrogen gas introducing tube. The content of the flask was heated with keeping the inside thereof in an inert atmosphere. Next, 0.05 g of dibutyl tin oxide were added so as to make a reaction at 200° C. while confirming the reaction at a softening point and, thereby a polyester resin containing insoluble chloroform in an amount of 17% by weight was prepared. The polyester resin is hereinafter called Polyester A.

The softening point thereof obtained by a ring and ball test (according to the test specified in JIS K 1351-1960) was 131° C.

EXAMPLE 1

The polyester A in an amount of 100 parts by weight, a carbon black 'Mogal L' (manufactured by Cabot Carbon Co.) in an amount of 10 parts by weight and a low molecular weight polypropylene 'Biscol 660P' (manufactured by Sanyo Chemical Co.) in an amount of 3 parts by weight were fused, kneaded, pulvelized and classified, so that Toner Powder A having an average powder size of 10 μm was obtained.

To 100 parts by weight of the Toner Powder A, one part by weight of aluminium oxide powder (having a powder size of 0.02 μm and a hydrophobicity at 70%) subjected to a hydrophobic treatment by making use of dimethyldicholorosilane, 0.5 parts by weight of a hydrophobic silica 'Aerosil R-812' (manufactured by Japan Aerosil Co.) and 0.1 part by weight of zinc stearate powder were added and mixed up altogether, so that Toner 1 was prepared.

On the other hand, an acetone solution of a copolymer of fluorovinylidene-tetrafluoroethylene was coated over to a ferrite member 'F-100' (manufactured by Japan Iron Powder Co.) by making use of a flow-table unit, so that Carrier A was prepared.

Then, Developer 1 was prepared by mixing up 28 g of Toner 1 with 772 g of Carrier A.

EXAMPLE 2

To 100 parts by weight of the same Toner Powder A as in Example 1, one part by weight of titanium oxide powder (having an average powder size of 0.03 μm and a hydrophobicity at 80%) subjected to a hydrophobic treatment by making use of dimethyl-dichlorosilane, 0.5 parts by weight of a hydrophobic silica 'Aerosil R-972' (manufactured by Japan Aerosil Co.) and 0.1 part by weight of zinc stearate powder were added and mixed up altogether, so that Toner 2 was prepared.

Then, Developer 2 was prepared by mixing up 28 g of Toner 2 with 772 g of Carrier A.

EXAMPLE 3

Styrene, butyl methacrylate and methyl methacrylate were copolymerized together at a copolymerization ratio by weight of 50:30:20. The resulted styrene-acryl resin, in an amount of 100 parts by weight, having a number average molecular weight of 9,700 and a weight average molecular weight of 138,000, a carbon black bMogal L' (manufactured by Cabot Carbon Co.) in an amount of 10 parts by weight, and a low molecular weight poly-propylelne 'Biscol 660P' (manufactured by Sanyo Chemical Co.) in an amount of 3 parts by weight were fused, kneaded, pulverized and classified, so that toner powders each having an average powder size of 10 μm were obtained. The resulted toners are hereinafter called Toner Powder B.

To 100 parts by weight of the Toner Powder B, 0.6 parts by weight of titanium oxide powder (having a powder size of 0.03 μm and a hydrophobicity of 80%) subjected to a hydrophibic treatment by making use of dimethyldichlorosilane, 0.4 parts by weight of a hydrophobic silica 'Aerosil R-972' (manufactured by Japan Aerosil Co.) and 0.05 parts by weight of zinc stearate powder were added and mixed up altogether, so that Toner 3 was prepared.

On the other hand, an acetone solution of 1,1',1''-trifluoromethacrylate polymer was coated over to globular-shaped iron powders 'DSP-138' (manufactured by Dowa Iron Powder Industry Co.) by making use of a flow-table unit, so that Carrier B was prepared.

Then, Developer 3 was prepared by mixing up 26 g of Toner 3 with 974 g of Carrier B.

EXAMPLE 4

To 100 parts by weight of the same Toner Powder B as in Example 3, 0.8 parts by weight of titanium oxide (having a powder size of 0.03 μm and a hydrophobicity of 80%) subjected to a hydrophobic treatment by making use of dimethyldichlorosilane, 0.4 parts by weight of a hydrophibic silica 'Aerosil R-805' (manufactured by Japan Aerosil Co.), and 0.05parts by weight of zinc stearate powders were added and mixed altogether, so that Toner 4 was prepared.

Then, Developer 4 was prepared by mixing up 28 g of Toner 4 with 772 g of Carrier A.

COMPARATIVE EXAMPLE 1

Comparative Example 1 was prepared in the same manner as in the case of preparing the Toner 2 in Example 2, except that zinc stearate was removed. Then, Comparative Developer 1 was prepared by mixing up 28 g of the Comparative Toner 1 with 772 g of Carrier A.

COMPARATIVE EXAMPLE 2

Comparative Example 2 was prepared in the same manner as in the case of preparing the Toner 2 in Example 2, except that hydrophobic titanium oxide powders and zinc stearate were removed. Then, Comparative Developer 2 was prepared by mixing up 28 g of the Comparative Toner 2 with 772 g of Carrier A.

COMPARATIVE EXAMPLE 3

Comparative Example 3 was prepared in the same manner as in the case of preparing the Toner 3 in Example 3, except that titanium oxide powders which was not subjected to any hydrophobic treatment was used. Then, Comparative Developer 3 was prepared by mixing up 28 g of the Comparative Toner 3 with 772 g of Carrier A.

COMPARATIVE EXAMPLE 4

Comparative Example 4 was prepared in the same manner as in the case of preparing Toner 1 in Example 1, except that the hydrophobic silica was removed. Then, Comparative Developer 4 was prepared by mixing up 28 g of the Comparative Toner 4 with 772 g of Carrier A.

With respect to each of the Developers 1 through 4 and Comparative Developers 1 through 4 prepared as mentioned above, the characteristics thereof were checked up in the following manner.

A negatively charged organic photoreceptor was prepared by providing an interlayer comprising a vinyl chloride-vinyl acetate-anhydrous maleic acid copolymer onto an aluminium-made drum and forming thereon a carrier-generating layer comprising a polycarbonate resin containing a brominated anthanthrone and, further, forming thereon a carrier transport layer comprising a polycarbonate resin containing an N-phenylstyryl carbazole derivative, and a 20,000 times of image reproductions were tried by making use of an electrophotographic coping machine 'U-Bix 2500' (manufactured by Konishiroku Photo Ind. Co., Ltd.), so as to check up the state where black spots were produced, the state where images were blurred, and every maximum density of images under the atmospheric conditions of a low temperature and a low humidity (that is called an L state), the standard atmospheric conditions (that is called an N state) and those of a high temperature and a high humidity (that is called an H state), respectively. The results thereof are shown in Table 1 attached hereto. It is obvious from the Table 1 that the excellent effects can be enjoyed in accordance with the toners of the invention.

TABLE 1

| | Toner | | | | | | Maximum image density Atmospheric condition | | |
|---|---|---|---|---|---|---|---|---|---|
| | | Additive | | | | | | | |
| | No. | Kind | Proportion | Carrier | State of black spot | State of blurred image | L | N | H |
| Developer 1 | Toner 1 | *$Al_2O_3$ | 1 | A | Not produced | Not produced | 1.3 | 1.3 | 1.2 |
| | | Silica | 0.5 | | | | | | |
| | | St-Zn | 0.1 | | | | | | |
| Developer 2 | Toner 2 | *$TiO_2$ | 1 | A | Not produced | Not produced | 1.3 | 1.3 | 1.1 |
| | | Silica | 0.5 | | | | | | |
| | | St-Zn | 0.1 | | | | | | |
| Developer 3 | Toner 3 | *$TiO_2$ | 0.6 | B | Not produced | Not produced | 1.3 | 1.3 | 1.1 |
| | | Silica | 0.4 | | | | | | |
| | | St-Zn | 0.05 | | | | | | |
| Developer 4 | Toner 4 | *$TiO_2$ | 0.8 | A | Not produced | Not produced | 1.3 | 1.3 | 1.1 |
| | | Silica | 0.4 | | | | | | |
| | | St-Zn | 0.05 | | | | | | |
| Comparative Developer 1 | Comparative Toner 1 | *$TiO_2$ | 1 | A | Produced | Not Produced | 1.3 | 1.3 | 1.1 |
| | | Silica | 0.5 | | | | | | |
| Comparative Developer 2 | Comparative Toner 2 | Silica | 0.5 | A | Produced | Produced | 1.2 | 1.2 | 1.0 |
| Comparative Developer 3 | Comparative Toner 3 | $TiO_2$ | 0.6 | A | Not produced | Not produced | 1.1 | 1.1 | 0.8 |
| | | Silica | 0.4 | | | | | | |
| | | St-Zn | 0.05 | | | | | | |
| Comparative Developer 4 | Comparative Toner 4 | *$Al_2O_3$ | 1 | A | Not produced | Produced | 0.9 | 0.9 | 0.6 |
| | | St-Zn | 0.15 | | | | | | |

$Al_2O_3$ is aluminium oxide; $TiO_2$ is titanium oxide; *represents a hydrophobic property; and St-Zn is zinc stearate; and the unit of the proportions of the additives is a part by weight.

What is claimed is:

1. A method of developing an electrostatic latent image comprising;

forming an electrostatic latent image with a negative polarity on an organic photoreceptor, and developing said electrostatic latent image with a toner bearing a positive electric charge, said toner comprising (a) a binder resin, (b) a coloring agent, (c) at least one oxide selected from the group consisting of hydrophobic aluminum oxide and hydrophobic titanium oxide, (d) silica, and (e) zinc stearate.

2. The method of claim 1, wherein said aluminum oxide and said titanium oxide are rendered hydrophobic by treatment with a compound selected from the group consisting of alkyl halogenated silane, alkyl alkoxy silane and alkylated silazane.

3. The method of claim 2, wherein said alkyl halogenated silane is dialkyl-di-halogenated silane, tri-alkyl-halogenated silane or alkyl-tri-halogenated silane; and said alkylated silazane is hexa-alkyl disilazane.

4. The method of claim 3, wherein said alkyl halogenated silane is dimethyl-dichlorosilane.

5. The method of claim 1, wherein said oxide has an average particle size of 0.001 μm to 1 μm.

6. The method of claim 5, wherein said average particle size is from 0.001 μm to 1 μm.

7. The method of claim 1, wherein said oxide comprises 0.01% to 10% by weight of said toner.

8. The method of claim 7, wherein said oxide comprises 0.05% to 5% by weight of said toner.

9. The method of claim 1, wherein said silica is a colloidal silica.

10. The method of claim 9, wherein said silica is a hydrophobic colloidal silica.

11. The method of claim 9, wherein said silica comprises 0.01% to 5% by weight of said toner.

12. The method of claim 11, wherein said silica comprises 0.5% to 2% by weight of said toner.

13. The method of claim 1, wherein said zinc stearate comprises 0.01% to 2% by weight of said toner.

14. A method of developing an electrostatic latent image comprising;

forming an electrostatic latent image with a negative polarity on an organic photoreceptor, and developing said electrostatic latent image using a developer comprising magnetic carrier particles bearing a negative electric charge and consisting essentially of said magnetic particles and a fluorinated resin coated on said magnetic particles; and toner particles bearing a positive electric charge and containing (a) a binder resin, (b) a coloring agent, (c) at least one oxide selected from the group consisting of hydrophobic aluminum oxide and hydrophobic titanium oxide, (d) silica, and (e) zinc stearate.

15. The method of claim 14, wherein said oxide is rendered hydrophobic by treatment with a compound selected from the group consisting of alkyl halogenated silane, alkyl alkoxy silane and alkylated silazane.

16. The method of claim 15, wherein said alkyl halogenated silane is dialkyl-di-halogenated silane, tri-alkyl-halogenated silane or alkyl-tri-halogenated silane; and said alkylated silazane is hexa-alkyl disilazane.

17. The method of claim 16, wherein said alkyl halogenated silane is dimethyl-dichlorosilane.

18. The method of claim 14, wherein said oxide has an average particle size of 0.001 μm to 1 μm.

19. The method of claim 18, wherein said average particle size is 0.001 μm to 1 μm.

20. The method of claim 14, wherein said oxide comprises 0.01% to 10% by weight of said toner.

21. The method of claim 20, wherein said oxide comprises 0.05% to 5% by weight of said toner.

22. The method of claim 14, wherein said silica is a colloidal silica.

23. The method of claim 22, wherein said silica is a hydrophobic colloidal silica.

24. The method of claim 22, wherein said silica comprises 0.01% to 5% by weight of said toner.

25. The method of claim 23, wherein said silica comprises 0.05% to 2% by weight of said toner.

26. The method of claim 14, wherein said zinc stearate comprises 0.01% to 2% by weight of said toner.

* * * * *